US005456009A

United States Patent [19]

Wexler

[11] Patent Number: 5,456,009

[45] Date of Patent: Oct. 10, 1995

[54] MULTI-BLADE RAZOR HEAD WITH IMPROVED PERFORMANCE

[75] Inventor: Fred C. Wexler, Madison, Conn.

[73] Assignee: Warner-Lambert Company, Morris Plains, N.J.

[21] Appl. No.: 294,463

[22] Filed: Aug. 23, 1994

[51] Int. Cl.[6] ..... B26B 21/14

[52] U.S. Cl. ..... 30/77; 30/50

[58] Field of Search ..... 30/41, 50, 77, 30/78, 84, 346.58

[56] References Cited

U.S. PATENT DOCUMENTS

| | | | |
|---|---|---|---|
| 1,035,548 | 8/1912 | Dickenson | 30/78 |
| 3,505,734 | 4/1970 | Iten . | |
| 3,555,682 | 1/1971 | Laszlo | 30/78 |
| 4,094,066 | 6/1973 | Daniel Jr. . | |
| 4,170,821 | 10/1979 | Booth . | |
| 4,211,006 | 7/1980 | Halaby . | |
| 4,252,837 | 2/1981 | Auton . | |
| 4,914,817 | 4/1990 | Galligan . | |
| 4,916,814 | 4/1990 | Althaus . | |
| 5,056,221 | 10/1991 | Thoene . | |
| 5,063,668 | 11/1991 | Althaus . | |
| 5,090,124 | 2/1992 | Althaus . | |
| 5,161,307 | 11/1992 | Althaus | 30/77 |
| 5,185,927 | 2/1993 | Rivers | 30/50 |

*Primary Examiner*—Hwei-Siu Payer
*Attorney, Agent, or Firm*—Charles W. Almer, III

[57] ABSTRACT

Shaving systems having a plurality of cutting edges. At least one fencing element is disposed proximate one cutting edge to prevent a plurality of discrete portions of that first cutting edge from contacting the skin surface being shaved. The other cutting edge is provided with a substantially continuously unobstructed cutting edge. The present invention provides a razor head design permitting skin flow characteristics of shaving to be altered by the fenced blade to affect safety in shaving while the substantially continuously unobstructed cutting edge is exposed to deliver a closeness not obtainable with a totally fenced shaving system.

20 Claims, 3 Drawing Sheets

MULTI-BLADE RAZOR HEAD WITH IMPROVED PERFORMANCE

The present invention is directed to razor heads and, more particularly, to razor heads comprising a plurality of cutting edges wherein at least one of the cutting edges is provided with a fencing element and at least one other cutting edge which is substantially unobstructed.

BACKGROUND OF THE INVENTION

Many different designs have been proposed in the past for providing a shaving instrument which provides a close, comfortable and safe shave. "Safety razors" are now common wherein a guard bar is disposed forwardly of the cutting edge of a leading blade while a skin-engaging cap member follows a trailing blade of a multi-blade shaving system. The guardbar and cap member help to control the angle at which the skin being shaved meets the cutting edges of the blades.

Another concept previously disclosed is to wrap all blades of a shaving system with a wire or thread to form a fencing element. This type of shaving system is particularly useful in maximizing safety and for use by people with sensitive skin. U.S. Pat. No. 1,035,548, issued Aug. 13, 1912, discloses a straight razor having a long blade on which is spirally wound a wire or thread to form a fencing element. Another form of fencing element is disclosed by Ferrara in U.S. Pat. No. 3,263,330, issued Aug. 2, 1966, wherein the razor blade cutting edge is encapsulated in a folded sheet of metal having a row of holes through which hair, but not skin, passes for cutting.

U.S. Pat. No. 3,505,734 issued to Iten on Apr. 14, 1970, discloses a cutting blade with a self-contained fencing element in the form of a wire. The wire or thread of selected diameter is wound about the body of the blade encompassing its ultimate edge. The spacing or pitch between successive turns of the wire is controlled relative to its diameter to provide protection to the skin of the user and to diminish the probability of cutting or nicking. The selected critical thread diameter and spacing between successive thread portions at the cutting edge of the blade allows the fenced portions of the blade to be drawn across the skin without coming into contact therewith. Some positional stability is given to the wound wire fencing elements by spot-welding them to the blade at a location back from its edge and by passing the wire through notches in the blade edge.

Another arrangement similar to that of Iten is disclosed in U.S. Pat. No. 3,750,285 to Michelson, issued on Aug. 7, 1973. The disclosed razor blade has a fenced cutting edge comprising a multiplicity of relatively short and thin fencing elements bent into relatively V-shaped form and secured to the blade edge by permanent attachment of the respective ends of each fencing element to the razor blade base structure at points relatively close to the blade cutting edge. Those fencing elements as well may be seated in notches formed in the blade edge or, if relatively softer than the blade edge, may have the blade edge embedded therein.

While the aforementioned designs of Iten and Michelson may be successful in insulating the skin from the ultimate cutting edge of the razor blade, they introduce difficulties into the manufacturing of razor blades incorporating their principal features. Initially, the thread or threads must be of flexible material having precise dimensional conformity. Secondly, it must also be sufficiently flexible for winding about the body of the blade or at least over the blade edge and yet strong enough to withstand severing as it passes over and comes into contact with the blade edge. It must be kept in mind that as the wire comes into contact with the ultimate edge of the blade, the edge being 300 to 500 Angstroms in radius, it necessarily damages the blade edge making such contact portion substantially incapable of providing comfortable shaving characteristics.

Techniques have been disclosed in U.S. patent application Ser. No. 645,055 filed Dec. 29, 1975, by Beddall for Printed Blade Shield, and U.S. Pat. No. 4,252,837 to Auton for Blade Shields, all being assigned to the same assignee as the present invention, for placing fencing elements on a blade edge without many of the shortcomings of the aforementioned prior art techniques. Specifically, epoxy resins may be placed on the edge and flanking facets of a blade using ink jet printing techniques or, alternatively, the fencing elements may be deposited by sputtering or ion plating. These techniques overcome some of the objections of the aforementioned prior art techniques. However, the fencing elements so deposited may be subject to dislodgement from the blade in response to normal shaving forces and/or abuse.

U.S. Pat. No. 4,211,006 to Halaby, et al, which issued on Jul. 8, 1980 and which is assigned to the same assignee as the present invention, discloses a razor blade having fencing elements deposited in recessed seats formed in the cutting edge and flanking surfaces of the blade by electroplating.

While the above-referenced publications disclose methods of making blades which will yield a more comfortable shave, those designs inherently sacrifice closeness in return for comfort. It would therefore be desirable to provide a razor head which is not only comfortable but also provides a close shave. To this end, it would be desirable to provide a razor head which is comfortable and which provides a closer shave than razor heads wherein all blades are protected by one or more fencing elements.

SUMMARY OF THE INVENTION

The various embodiments of the present invention are directed to razor heads having a plurality of cutting edges wherein at least one of the cutting edges is substantially continuously unobstructed and at least one fencing element is disposed over discrete, spaced portions of another cutting edge to prevent those portions of that cutting edge from contacting the surface being shaved.

According to one preferred embodiment, a razor head is provided with structure for supporting a plurality of blades, a first blade comprising a first cutting edge, and a second blade comprising a second cutting edge. According to this embodiment, the first blade comprises at least one fencing element disposed over the cutting edge of that blade which prevents a plurality of discrete portions of that first cutting edge from contacting the skin surface being shaved. According to this embodiment, the second blade is provided with a substantially continuously unobstructed cutting edge. For example, in a twin-blade shaving system, one blade is wire wrapped or otherwise fenced while the other blade is not wire wrapped or fenced.

The embodiments of the present invention provide a razor head design which permit the skin flow characteristics of shaving to be altered by the fenced blade to affect safety during shaving while the unfenced blade member, with the substantially continuously unobstructed cutting edge, is exposed to deliver a closeness not obtainable with a totally fenced blade system. The present invention is particularly suited to provide a safe and close shave to people with regular skin by providing substantially the same safety as systems where both blades are wrapped or otherwise fenced, while providing enhanced closeness. This is particularly desirable for shavers with "normal" skin, as opposed to those with "sensitive" skin.

DETAILED DESCRIPTION

The various embodiments of the present invention are directed to shaving systems comprising a plurality of cutting edges. At least one cutting edge is substantially continuously unobstructed while a plurality of discrete portions of another cutting edge are shielded by at least one fencing element which prevents those discrete portions of the cutting edge from contacting the skin surface being shaved. A preferred embodiment of the present invention comprises a razor head having at least two blades wherein portions of the cutting edge of one of the blades are shielded with at least one fencing element which effectively prevents contact between discrete, spaced portions of the cutting edge and the surface being shaved. The cutting edge of the other blade is substantially continuously unobstructed.

Figure 1:
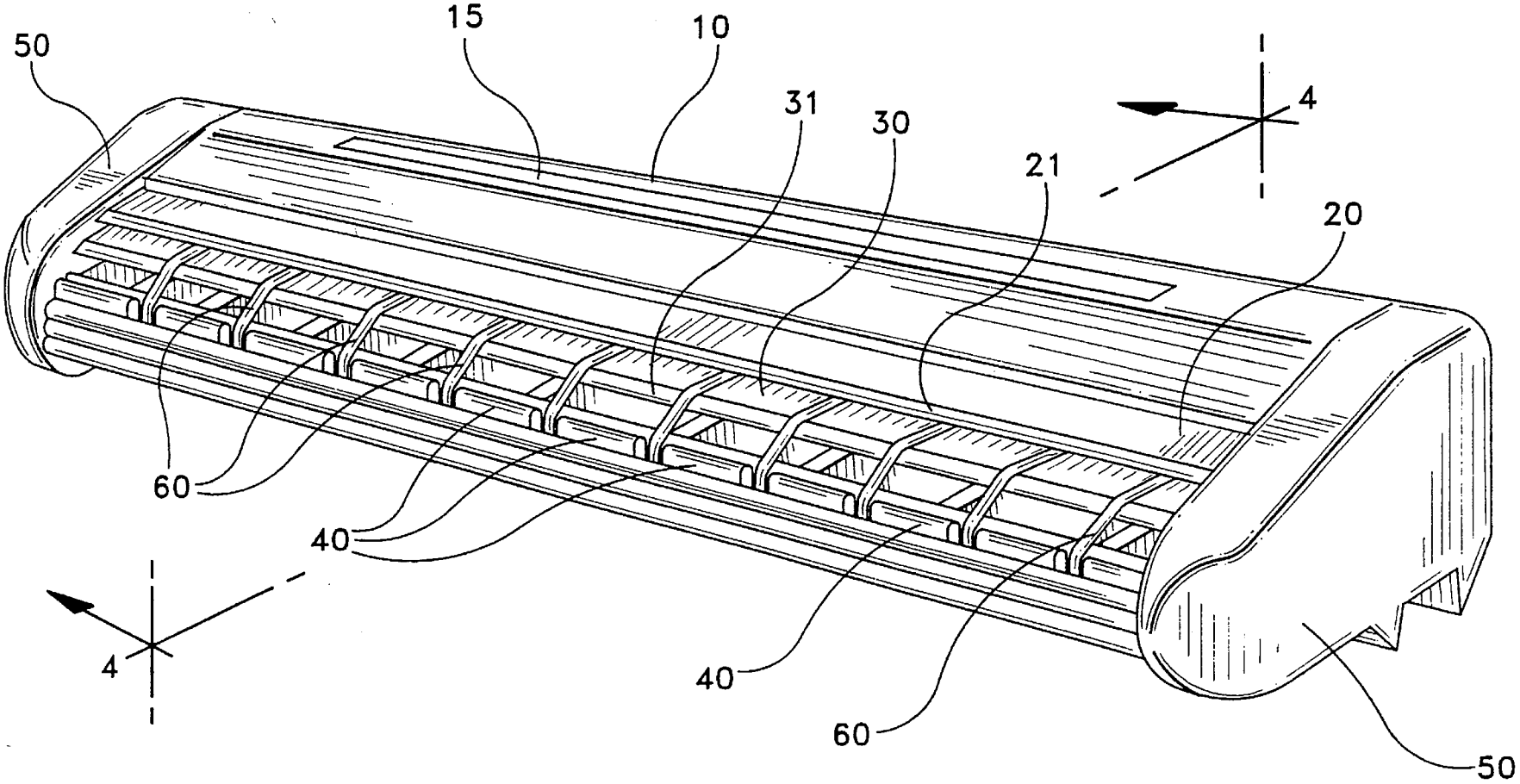
FIG. 1 is a perspective view of one embodiment of the present invention.
Figure 2:
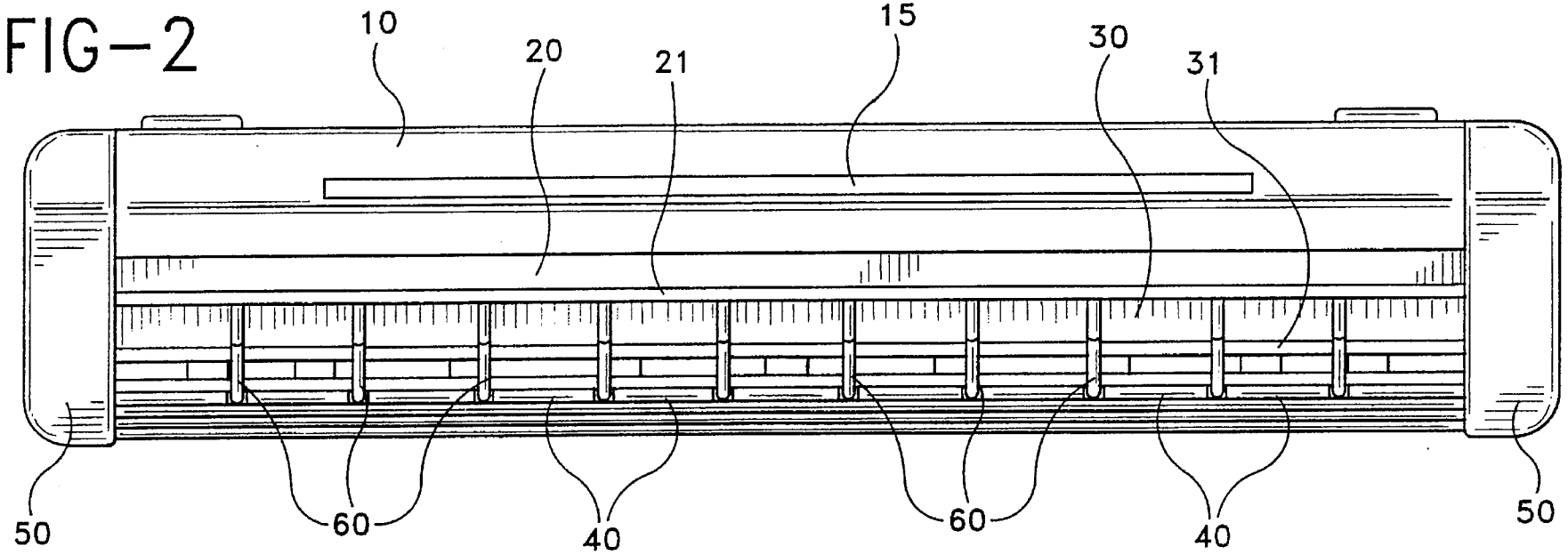
FIG. 2 is a top view of the razor shown in FIG. 1.
Figure 3:
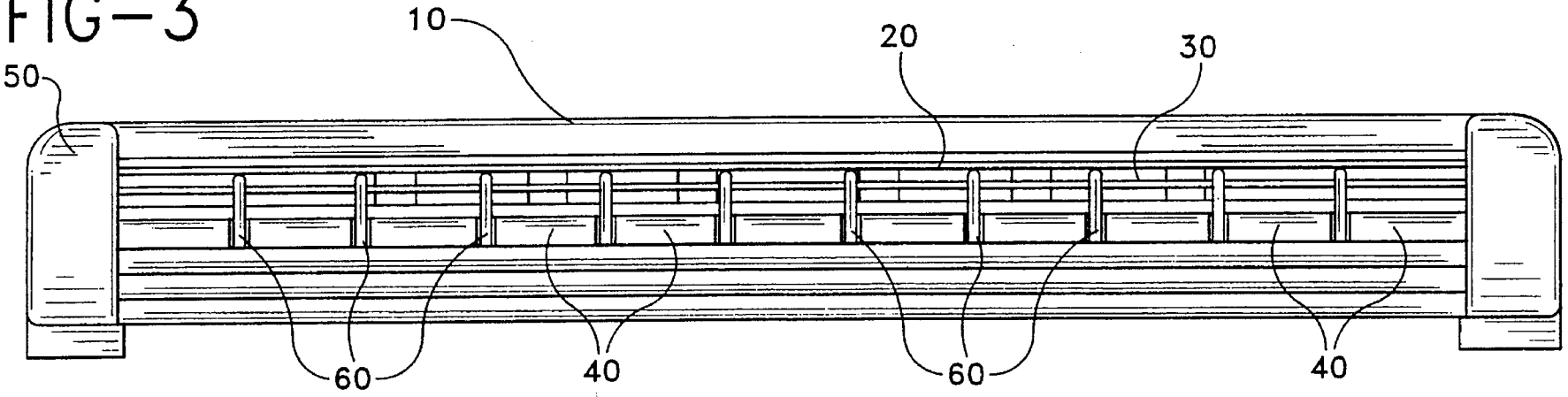
FIG. 3 is a front view of the razor head shown in FIG. 1.
Figure 4:
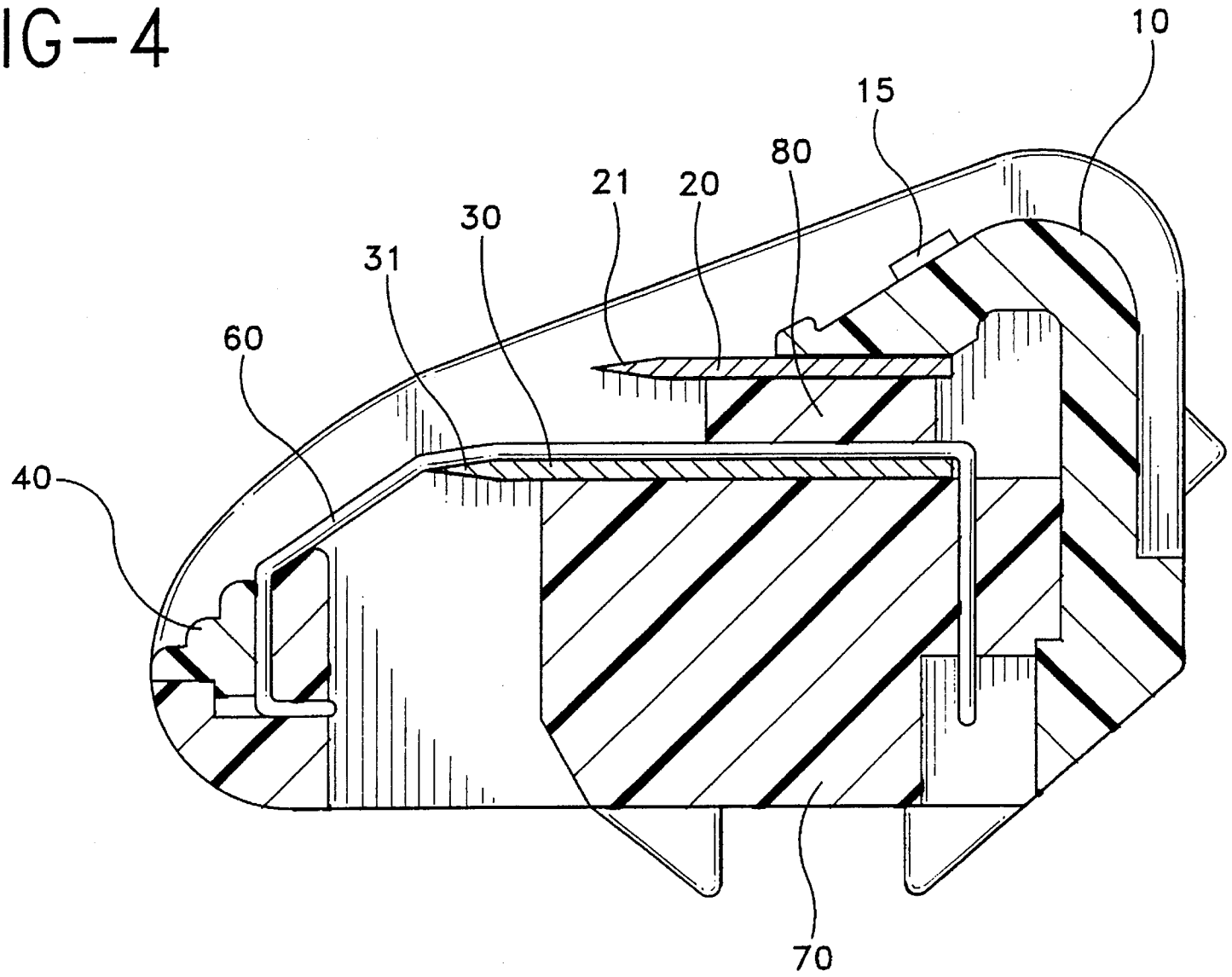
FIG. 4 is a cross-sectional of view taken along lines 4—4 of FIG. 1.

One embodiment of the present invention is illustrated in FIGS. 1 to 4 wherein a razor head comprises a cap 10, a cap blade 20, seat 70, spacer 80, seat blade 30, and segmented guardbar 40 positioned between sidewalls 50. While the illustrated razor head is in the form of a cartridge adapted to be connected to a separate razor, the advantages of the present invention are equally applicable to other razor heads and other shaving systems. As used herein, the term "razor head" is meant to include cartridges adapted to be connected to a separate razor as well as the operative cutting portion of a disposable razor wherein the handle and cutting portion are formed as a single unit.

As shown in the Figures, cap blade 20 comprises a cutting edge 21 which is unobstructed for substantially its entire length. It will be appreciated that for purposes of the present invention, it is not necessary that the entire cutting edge of the "unobstructed" blade be exposed for contact with the surface being shaved. It is common in previously known shaving systems to position the corners of a substantially rectangular blade within shielded portions of the support structure, such as sidewalls 50, in order to minimize the risk of cutting the surface being shaved during shaving. As used herein, the term "substantially, continuously unobstructed" is used to indicate that a portion of the cutting edge equal to at least 50% of the entire cutting edge is continuously exposed for cutting hair.

With reference again to the Figures, it can be seen that a plurality of discrete, spaced portions of cutting edge 31 of seat blade 30 are prevented from contacting the skin surface being shaved by fencing elements 60. As best shown in the cross-sectional view of FIG. 4, according to this illustrated embodiment of the present invention, each fencing element 60 is advantageously positioned in close proximity to the upper surface of seat blade 30 and the upper side of cutting edge 31. Each fencing element is maintained in position by portions of the support structure disposed forwardly and rearwardly of seat blade 30. In the manner illustrated, the forward and rearward portions of fencing element 60 are locked within the molded thermoplastic material. According to this preferred, illustrated embodiment of the present invention, there is no portion of seat blade 30 which extends continuously for more than 15% of the entire cutting edge between fencing elements 60.

Though not illustrated in detail in the Figures, the illustrated shaving cartridge is also provided on its lower side with suitable connecting members for attachment to a razor. The materials used for forming the various elements of the razor head may include a wide variety of materials. For example, it is known in the art to use thermoplastics which are particularly suited for injection molding and which have excellent durability and shelf life in the environments particularly encountered during shaving, shipping and storing.

While the illustrated fencing elements 60 are formed as a continuous filament which wraps in a generally spiral fashion around one or more, but less than all, of the blades, it is also within the scope of the present invention to use a plurality of discrete elements. It is also possible to use fencing elements which are deposited in recessed guard seats such as those disclosed in U.S. Pat. No. 4,211,006 to Halaby et al, and assigned to the same assignee as the present invention, which is hereby incorporated by reference. Furthermore, one or more fencing elements can be formed as a stamped sheet, e.g. by stamping holes in a metallic foil.

Though the illustrated embodiment comprises a seat blade having a plurality of fencing elements and a substantially continuously unobstructed cap blade, this arrangement can be reversed within the scope of the present invention. Thus the cap blade may be provided with fencing elements while the seat blade can be substantially, continuously unobstructed. Furthermore, it is within the scope of the present invention to provide a shaving system with more than two blades having cutting edges wherein at least one cutting edge is substantially, continuously unobstructed while at least one other cutting edge is protected by fencing elements.

Another preferred aspect of the present invention comprises the incorporation of a shaving aid on one or more of the skin-engaging surfaces of the shaving system.

As disclosed in U.S. Pat. No. 4,170,821 to Booth, which is hereby incorporated by reference, a shaving aid may comprise one or various combinations of the following:

A. A lubricating agent for reducing the frictional forces between the razor and the skin, e.g., a micro-encapsulated silicone oil.

B. An agent which reduces the drag between the razor parts and the shaver's face, e.g., a polyethylene oxide in the range of molecular weights between 100,000 and 6,000,000; a non-ionic polyacrylamide; and/or a natural polysaccaride derived from plant materials such as "guar gum".

C. An agent which modifies the chemical structure of the hair to allow the razor blade to pass through the whiskers very easily, e.g., a depilatory agent is one example.

D. An cleaning agent which allows the whisker and skin debris to be washed more easily from the razor parts during shaving, e.g., a silicon polyethylene oxide block copolymer and detergent such as sodium larnyl sulphate.

E. A medicinal agent for killing bacteria, or repairing skin damage and abrasions.

F. A cosmetic agent for softening, smoothing, conditioning or improving the skin.

G. A blood coagulant for the suppression of bleeding that occurs from nicks and cuts.

Alternatively, the shaving aid may comprise one or more of the shaving aids disclosed in U.S. Pat. No. 5,056,221 to Thoene, which is also hereby incorporated by reference. A shaving aid 15 dispose on cap 10 is shown in the FIGS. 1 and 2.

What is claimed is:

1. A razor head comprising:

means for supporting a plurality of blades;

a first blade comprising a first cutting edge and a second blade comprising a second cutting edge;

at least one fencing element, wherein said at least one fencing element prevents a portion of said first cutting edge from contacting a surface being shaved; and wherein second cutting edge is substantially continuously unobstructed.

2. A razor head according to claim 1 wherein said at least one fencing element prevents a plurality of discrete portions of said first cutting edge from contacting a surface being shaved.

3. A razor head according to claim 1 wherein said fencing element comprises a filament which is wrapped around said first blade.

4. A razor head according to claim 1 comprising a plurality of discrete fencing elements positioned in spaced relation over said first cutting edge.

5. A razor head according to claim 4 wherein said fencing elements are anchored forwardly and rearwardly of said first blade.

6. A razor head according to claim 1 wherein said at least one fencing element is anchored in a thermoplastic material.

7. A razor head according to claim 1 wherein said first blade is disposed forwardly of said second blade.

8. A razor head according to claim 1 wherein said first blade is disposed rearwardly of said second blade.

9. A razor head according to claim 1 further comprising a shaving aid.

10. A shaving system comprising:

means for cutting hair comprising at least a first cutting edge and a second cutting edge:

means for supporting said cutting means;

at least one fencing element, wherein at least a portion of said fencing element is disposed proximate said first cutting edge to prevent a portion of said first cutting edge from contacting a surface being shaved; and wherein said second cutting edge is substantially continuously unobstructed for contact with a surface being shaved.

11. A shaving system according to claim 10 wherein said at least one fencing element prevents a plurality of discrete portions of said first cutting edge from contacting a surface being shaved.

12. A shaving system according to claim 10 comprising a plurality of discrete fencing elements positioned in spaced relation over said first cutting edge.

13. A shaving system according to claim 10 wherein said at least one fencing element is anchored in a thermoplastic material.

14. A shaving system according to claim 10 wherein said at least one fencing element is anchored forwardly and rearwardly of said first cutting edge.

15. A shaving system according to claim 10 wherein said fencing element comprises a continuous filament.

16. A shaving system according to claim 10 wherein said fencing element comprises a thermoplastic material.

17. A shaving system according to claim 10 wherein said fencing element comprises a stamped foil.

18. A shaving system according to claim 10 wherein said fencing element comprises a metallic substance deposited by electroplating deposition.

19. A shaving system according to claim 10 wherein said fencing element comprises an epoxy resin.

20. A shaving system according to claim 10 further comprising a shaving aid.

* * * * *